US007841754B2

(12) United States Patent
Young

(10) Patent No.: US 7,841,754 B2
(45) Date of Patent: Nov. 30, 2010

(54) POST LANTERN WIRING SYSTEM, ILLUMINATION, AND ENERGY SOURCE CONVERSION DEVICE

(76) Inventor: Mark A. Young, 2448 E. 39th St., Anderson, IN (US) 46013

( * ) Notice: Subject to any disclaimer, the term of this patent is extended or adjusted under 35 U.S.C. 154(b) by 0 days.

(21) Appl. No.: 11/679,259

(22) Filed: Feb. 27, 2007

(65) Prior Publication Data

US 2007/0201228 A1 Aug. 30, 2007

Related U.S. Application Data

(60) Provisional application No. 60/767,040, filed on Feb. 27, 2006.

(51) Int. Cl.
*F21V 21/00* (2006.01)

(52) U.S. Cl. ..... 362/431; 362/414; 362/276

(58) Field of Classification Search ..... 362/153, 362/431, 276, 251, 263, 265, 453, 153.1, 362/249, 414, 184, 249.01, 249.14; 439/168
See application file for complete search history.

(56) References Cited

U.S. PATENT DOCUMENTS 3,916,249 A * 10/1975 Ackermann ..... 315/73
4,575,659 A * 3/1986 Pezzolo et al. ..... 315/159
4,782,430 A * 11/1988 Robbins et al. ..... 362/562
4,827,389 A * 5/1989 Crum ..... 362/388
2003/0223232 A1 * 12/2003 Belfer et al. ..... 362/219

* cited by examiner

*Primary Examiner*—Thomas M Sember
(74) *Attorney, Agent, or Firm*—Ritchison Law Offices

(57) ABSTRACT

Device and wiring system of present invention allows for conversion of natural gas powered and 110 voltage post lantern lights to 12-volt or 24 volt electric energy by utilizing a copper bulb housing, attached to a stem, being hollow, wherein two center contact wires extend from stem, a third center contact wire being soldered to a copper ring, fitting into bulb housing stem sleeve groove. The soldered center contact wire being utilized for 12 volt wiring, and ignored for 24 volt wiring. Device wires are wired to separate center contact wires extending within post lantern pole, across residential lawns, to a transformer, plugging into a residential type (110 volt) power line. Device replaces previous gas or 110 electric fixture components with utilization of inverted bulb device and invention's wiring procedure, comprising copper ring soldered to center contract wire for 12 volt, and ignoring soldered wire for 24 volts.

9 Claims, 4 Drawing Sheets

POST LANTERN WIRING SYSTEM, ILLUMINATION, AND ENERGY SOURCE CONVERSION DEVICE

CROSS-REFERENCE TO RELATED APPLICATIONS

This application claims priority to a provisional patent application which has been assigned U.S. Ser. No. 60/767,040, filed Feb. 27, 2006, filed by the inventor and titled "Post Lantern Energy Conversion Device."

SEQUENCE LISTING OR PROGRAM

U.S. Pat. No. 4,835,748;
U.S. Pat. No. 4,577,265;
U.S. Pat. No. 4,616,299 to Krause
U.S. Pat. No. 5,398,180 to Lee
U.S. Pat. No. D461921S to Ellis
U.S. Pat. No. 4,785,384 to Swald

BACKGROUND OF THE INVENTION-FIELD OF INVENTION

The present invention relates to a retrofit device and post lantern electric wiring system, particularly in relation to a device and conversion wiring system used to convert natural gas burning lanterns to electric, or to convert high voltage electric to low voltage lighting. The present invention also relates to energy conservation, cost efficiency, increased safety, a post lantern 12-volt wiring system, and incandescent or LED simulation of gas lighting.

A. BACKGROUND OF THE INVENTION

Post lantern lighting is a type of exterior lighting, commonly on the top of a metal pole, used for night and sometimes day lighting for both safety and decorative purposes. Post lantern lighting is historically known as gas lighting, gas being the original energy source for post lantern illumination. Gas was commonly utilized as the primary source of illumination, with gaslights existing both interior and exterior during that era. As electric energy became much more efficient as a source of illumination, efforts to replace gas illumination with electric lighting were pursued, however, the last twenty years have presented renewed interest in residential exterior natural gas lighting, with historical and modern residential gas burning lights existing across the United States and internationally.

The recent gas crisis, however, has given rise to renewed interest in energy conservation and cost efficiency, leading to increased awareness in alternative methods of power.

B. INTRODUCTION OF PROBLEMS ADDRESSED

Though post-lantern, electrical gas light fixtures have been available in the lighting market, they are primarily 110 volts, as referenced in U.S. Pat. No. 4,835,748, 4,577,265, and 4,616,299 to Krause. Such lighting utilizes a single bulb, and was meant to replace existing electric lighting fixtures, more closely simulating the glow of gas lighting, rather than serve as a means of converting gas power. These inventions utilize only one 110-volt bulb, whereas traditional gas lighting more commonly results from two mantles.

Other available products, include high pressure, solar powered, fluorescent or reflective technologies as alternatives to gas powered luminaries. Solar powered lighting, as well as many reflective technologies are more compatible with small terrain, pathway, or garden lighting, in which a small lantern hangs from a four pronged metal rod or is connected to the ground by a stake as referenced in U.S. Pat. No. 5,398,180, Lee, and U.S. Pat. No. 461,921, Ellis.

Reflective lighting in post lantern mantle technologies, however, does exist. Such inventions attempt to simulate the glow of gas lighting, rather than serving as a means of electrical conversion. Florescent and solar power in post lantern lighting also exists, but does not adequately resemble gas lighting, as illumination is bright white, and does not resemble the glow of gas lighting. Fixtures often are for a single bulb, and were designed as alternative lighting, and not necessarily with post lantern conversion in mind. Florescent lighting is also not a reasonable alternative to gas lighting due to incident of failure in subfreezing climate zones.

Two-mantled gaslight fixtures have existed for some time in the marketplace, but are restricted to the Internet and therefore not available to a mass market. The primary purpose of these products is conversion of post lantern gaslights to electric power, but they are not available or convertible to 12 volts. Products are also inferior, containing a high ratio of plastic, with a small amount of aluminum. Plastic utilized in heat sensitive areas, such as within housing bulb sockets melt and deform over time, when bulb heat increases. Such products generally offer a two-year life span, at which time internal components corrode, crack, melt, and plastic disassembles from housing, resulting in replacement. Most products are offered at voltages of 110 , which often represent safety issues, including incident of shock, short circuiting of conversion devices, power surges traveling from post lantern wires to main residential power lines during electrical storms, and short circuiting of interior appliances.

Homeowners attempting to simulate the gaslight look encounter problems in the marketplace when converting gas burning post lanterns to electric light since fixtures available on the mass market are single-sockets, adaptable to a single, incandescent or solar light bulb at the bottom of the lamp-head. Problems with condensation surrounding the bulb socket exist, which leads to deterioration of sockets, short circuiting and product replacement.

Lamp-heads for gas burning post lanterns are not always adaptable to electric conversion. Upright bulb sockets collect moisture within sockets, presenting increased opportunity for short circuiting, socket deterioration, increased safety hazard and incident of electrocution and consumer fatality. Therefore gas lamp-heads are not adaptable to 110 electrical use. Approved lamp-heads for 110 v electrical use are necessary for consumer safety. This increases both expense and time when converting natural gas burning lamps to electric. State laws generally require that when dealing with 110 volts certified electricians must install products, leading to even more expense for the consumer.

Consumers when relying on available post lantern fixtures in hardware and department stores to convert gaslights are restricted to upright, single socket fixtures. Screw-in bulbs are then utilized with a bulb socket at 110, 24 and 12 volts, but do not simulate retro-fit or glow of traditional gas-lighting. The only options presently available to consumers attempting to simulate gas-lighting are specialty screw-in bulbs, such as referenced in U.S. Pat. No. 4,785,384, Swald. These, however, do not adequately resemble or simulate the overall experience of traditional gas lighting.

Many gaslight owners, due to rising expenses of natural gas are shutting off use of post lantern lights. With rising gas costs a single post lantern, natural gas burning light costs hundreds of dollars a year to operate. Shutting off use, however, sometimes presents safety and lighting issues to communities, particularly for those whose gas lights serve as street-lighting. Many housing associations now require homeowners with gas burning yard lights to convert to electric due to rising costs, as well as safety concerns. Community aesthetics and historical culture are a concern and are often lost when post lantern heads and fixtures must be replaced in order to convert gaslights to electric. Antique lamp-heads are often worth hundreds, sometimes thousands of dollars, and may have existed in communities for over a hundred years. Expanding budgets for individual homeowners, housing associations and city governments, attempting to provide adequate residential and city street-lighting presents significant financial setbacks for those still utilizing natural gas. No product presently exists in the marketplace which adequately addresses both financial and aesthetic concerns.

SUMMARY OF THE INVENTION

The present invention relates to a retrofit device and post lantern electric wiring system The present invention comprises a post lantern retrofit low voltage conversion device and electric wiring system, for post lantern gaslights and high voltage wiring systems. Conversion is achieved by replacement of gas emitting components with low voltage wiring and bulb tree illumination device for natural gas burning lights. Conversion of high voltage wiring systems is achieved with post lantern electrical low voltage wiring and bulb tree illumination device system. Conversion occurs by use of post lantern device replacing prior lamp components, and by wiring of device to center contact wires, also wired to a low voltage power source. Illumination occurs when single contact bayonet bulbs are placed in bulb sockets and power supply is plugged into main residential type (110 Volts) power line.

Invention is adaptable to either 12-volt system or 24-volt systems by ignoring the center contact wire soldered to ring of copper bulb socket housing, and series wiring the device using only the center contact wires.

The invention converts natural power source from gas energy to electric through a conversion device and wiring system. It may also be utilized to convert high voltage post lanterns to low voltage through a conversion device and wiring system. Electric power is derived from an associated transformer. The transformer plugs into residential type (110 volts) power line. The light source is illuminated by use of single bayonet bulbs, and optional dusk to dawn photo-sensors that detect ambient light, causing automatic illumination at sunset, and automatically shutting off at dawn.

In accordance with the invention, the bulb tree illumination device comprises a copper bulb socket housing assembly, with inverted bulb sockets and a descending stem sleeve, wire springs, and a center contact spacer allowing for attachment of bulbs at each bulb socket. The copper bulb socket housing assembly connected to tube, which extends from the copper stem sleeve, being hollow, having an opening at the bottom, where center contact wires extend through and beneath stem for further wiring directly above post lantern pole. Center contact wires at each side of bulb socket having a bulb socket spring and fiberglass center contact spacer assembled above bulb placement. A third center contact wire being soldered to copper ring, fitting into copper stem sleeve groove for parallel wiring. Post Lantern Conversion device center contact wires being wired parallel or series wired to separate center contact wires, dependant on wiring system preferred. Center contact wires extending within pole, being placed within ground of residential lawns, to extend to power source. Center contact wires being wired to power source, power source being plugged to main residential type (110 volts) power connection, bulbs being placed in both right and left bulb sockets.

OBJECTS AND ADVANTAGES

The current invention utilizes a copper housing, coupled with a 12-volt wiring system, which is safer, energy conserving, cost efficient and completely eliminates device replacement. The system utilizes parallel wiring, rather than more common series wiring, adapting to existing 12-volt transformers, and energy saving dusk to dawn controls currently offered in the market. By utilization of a copper housing the current invention also prevents corrosion of internal and external components, as well as prevention of cracking, melting and housing disengagement. The system utilizes inverted bulb sockets, which repel moisture, prevent short-circuiting, reduce socket deterioration, and duplicate the traditional two mantle gas-light. The invention also utilizes a 12-volt wiring system, with an extra wire soldered to a copper ring, which connects to a copper housing stem sleeve groove for parallel wiring, to be used in correlation with a 12-volt transformer and dusk to dawn system, preventing excessive heat in bulb sockets. The invention easily works in correlation with 12-volt systems, in which one transformer is utilized for multiple devices.

The existing invention is also convertible to 24 volt wiring systems and transformers, in which the middle soldered wire is ignored, and regular, series wiring is conducted, making the post lantern energy conversion device adaptable to 24-volt systems.

The system is not restricted to gas light conversions, but may also be utilized to convert 110-volt post lantern wiring systems to low volt systems, increasing safety, reducing incident of shock and short-circuiting. It may also be utilized to replace an existing one-bulb fixture system with the current invention's two bulb fixture, more closely by simulating gas lighting.

The system may be used in existing lamp heads to convert from gas energy to electric, to convert high voltage electric to low voltage, therein saving consumers time and money, reducing community city and government budgets, as well as preserving community aesthetics, historical culture and relevance. The system may also be used in new post lantern systems to maintain cultural relevance with increased safety.

Bulb sockets of device are adaptable to any single contact bayonet bulb, which includes incandescent and longer lasting LED bulbs. Because the device utilizes single contact bulbs, device is adaptable to both incandescent and LED bulbs, without purchase of specialty lamp heads.

Currently, the only 12-volt exterior wiring systems available on the market are small, walk-way style lights, small, decorative garden terrain lights, connected to the ground by a stake, and 12 volt single bulb fixtures that connect to post lantern heads in an upright position at the bottom of the head. Broadly considering the market as a whole, post lantern lighting is generally offered at 110 volts with upright single bulbs, and presents increased hazard and liability when compared with the safer Post Lantern Energy Conversion Device, in which a 12-volt retrofit device and post lantern electric wiring and illumination system is utilized.

BRIEF DESCRIPTION OF DRAWINGS

Advantages of the present invention will be apparent from the written description and the drawings which are described below.

DESCRIPTION OF THE DRAWING—REFERENCE NUMERALS

Figure 1:
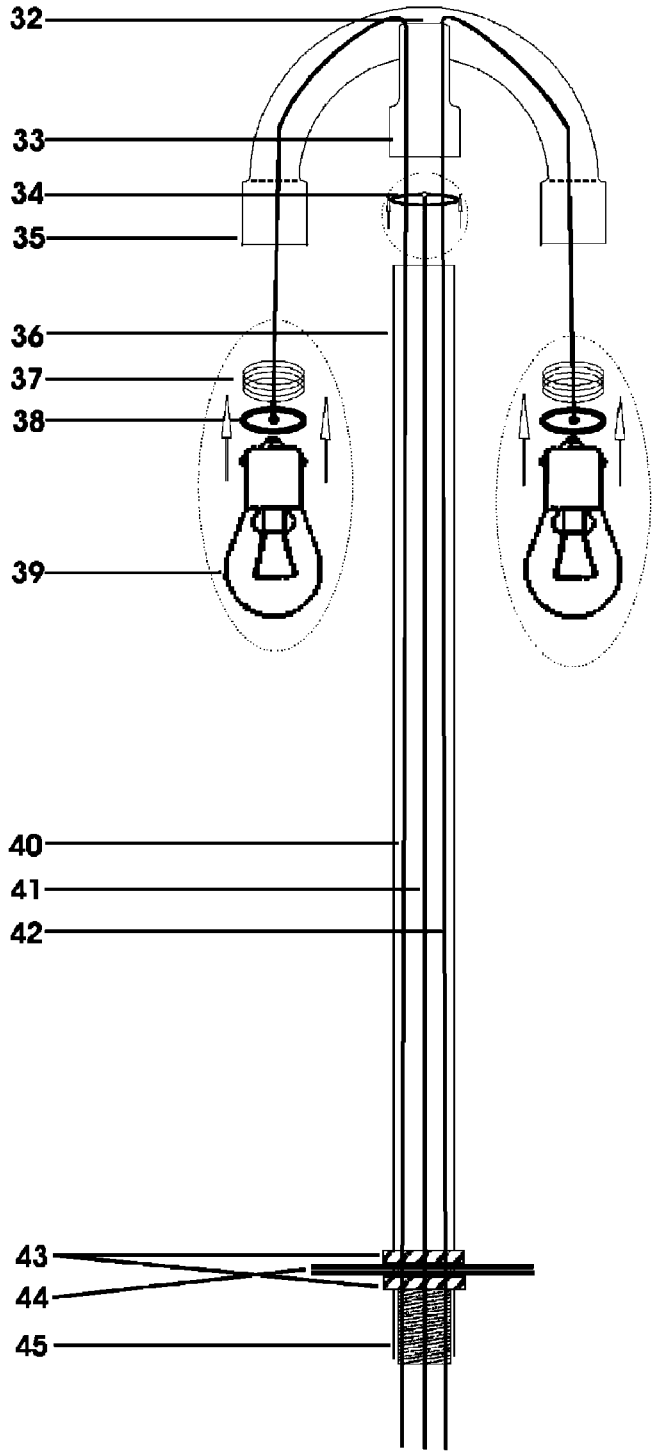
FIG. 1—Full view of a post-lantern, low-voltage energy conversion fixture and illumination device in accordance with the present invention.

The following list refers to the drawings:

32 copper bulb housing assembly
33 copper stem sleeve
34 center contact ring
35 spun copper socket
36 CPVC or copper stem
37 bulb socket springs
38 fiber glass insulator with brass nib connected to center conductor wire
39 single contact bayonet lighting bulbs
40 center contact wire (left side)
41 ground wire
42 center contact wire (right side)
43 half inch flat nut
44 1 3/25 fender washer
45 1 3/25 quarter inch IP threaded nipple
46 lamphead
47 Post lantern low voltage energy conversion device
48 lamphead base
49 12 volt wiring system transformer
50 24 volt wiring system transformer
51 dawn to dusk photo-sensor
52 dawn to dusk photo sensor

DESCRIPTION OF PREFERRED EMBODIMENT

Referring to the drawings, and especially that of FIG. 1, the post lantern low voltage energy conversion fixture and wiring system is illustrated having a copper bulb housing assembly 32, having bulb sockets 35 and a stem sleeve 33, a hollow copper stem 36, through which runs a center contact parallel wire lead 41 soldered to copper ring 34 and two center contact wires 40, 42, a spring 37 a center contact spacer 38 installed in each bulb socket of the bulb housing assembly, two single contact bayonet bulbs 39 insert in the bulb socket, flat nuts 43, fender washers 44, and a threaded nipple 45.

Figure 2:
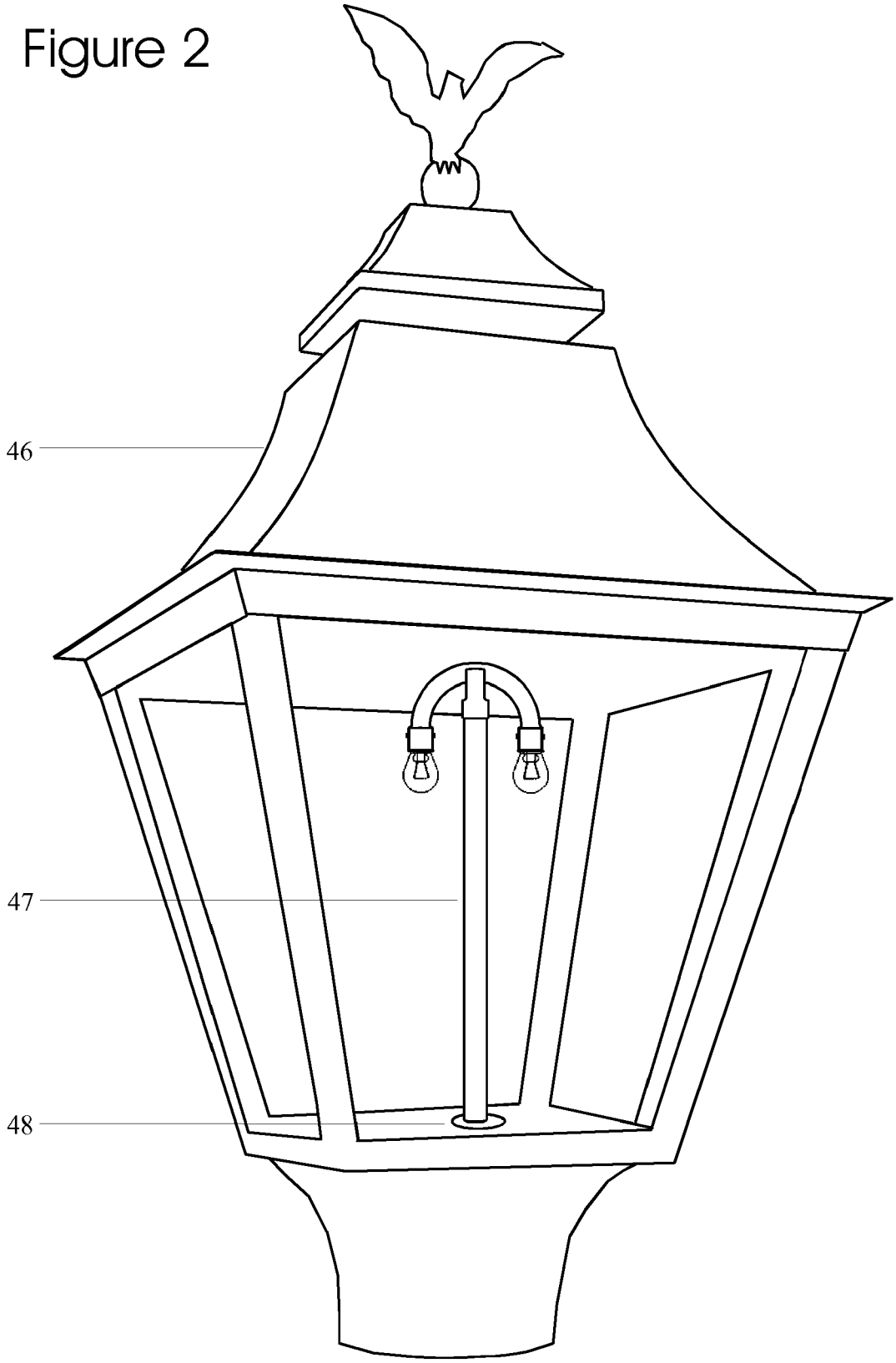
FIG. 2—Full view of a post lantern, low voltage energy conversion fixture, within an associating lamp head, shown in accordance with invention in upright position, having been wired to lamp head base.

FIG. 2 illustrates the full view post lantern, low voltage energy conversion device 47 within an associated lamp head 46, after removal of post lantern gas emitting components from lamp head base 48.

FIG. 3A illustrates an electrical wiring schematic of post-lantern, low-voltage energy conversion parallel wiring system showing an associated 12-volt transformer 49, and FIG. 3B illustrates a series wiring system showing an associated 24 volt transformer 50. FIG. 4A illustrates an electrical wiring schematic of a post-lantern low voltage energy conversion parallel wiring system showing an associated dawn to dusk photo-sensor 51 and associated 12-volts transformer 49, and FIG. 4B illustrates a series wiring system showing an associated dawn to dusk photo-sensor 52 and associated 24-volt transformer 50.

Thus, in operation, the post lantern 12 volt energy conversion wiring system illustrated in FIG. 1, is attached to center contact wires 40, 42, which act as one wire, and are parallel wired. Lead 41 is insulated from and runs coaxial with center contact wires 40, 42 and is buried within the earth, extending and wired to transformer 49, plugging into a residential type (110 volts) outlet, as best shown in FIG. 3A. As illustrated in FIG. 1, in parallel wiring, 40 and 42 are wired to center contact wire lead 41 through the bulb filaments. Wire lead 41 is ignored in series wiring, the bulb bases being electrically connected through the copper bulb housing assembly, thus completing the circuit.

Figure 3:
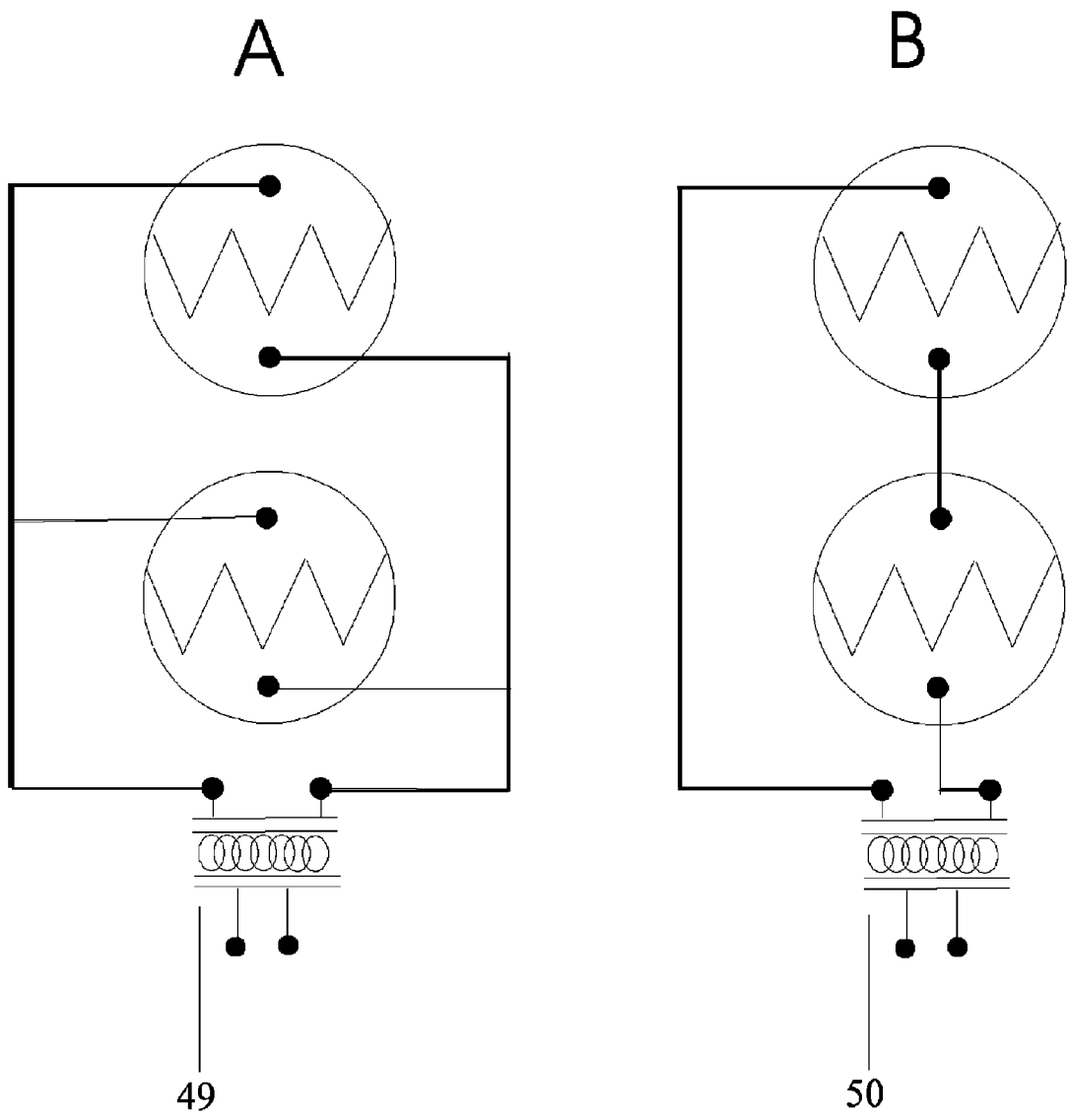
FIG. 3—Electrical wiring schematic of post-lantern, low-voltage energy conversion parallel wiring system in accordance with invention, and an electrical wiring schematic of post-lantern, low voltage energy conversion series wiring system.
Figure 4:
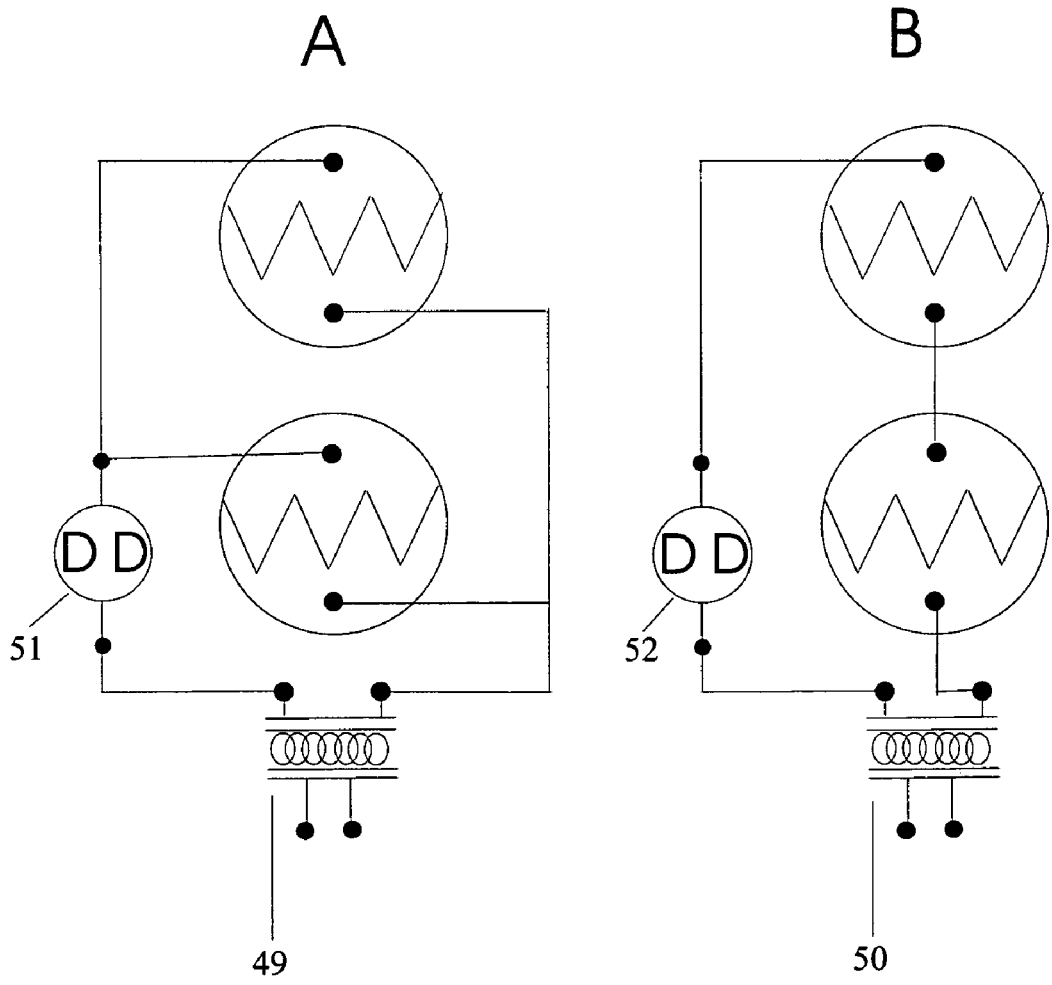
FIG. 4—Electrical wiring schematic of post-lantern, low-voltage energy conversion parallel wiring system with dusk to dawn photo-sensor in accordance with invention, and an electrical wiring schematic of post-lantern, low voltage energy conversion series wiring systems with dusk to dawn photo-sensor.

The post lantern wiring and illumination device in accordance with the invention are illustrated in FIG. 3 for use in converting natural gas burning lights to 12 or 24 volt power. Illumination is illustrated in FIG. 1, wherein bulbs 39 plug into copper housing sockets 35.

Replacement of gas emitting components is best illustrated in FIG. 2, in which post lantern low voltage energy conversion device 47 is attached to lamp base 48 by use of attachments best illustrated in FIG. 1, wherein flat nuts 43, and washers 44 are assembled onto threaded nipple 45, which extends from copper stem 36, therein replacing gas components. Post lantern low voltage energy conversion device, as illustrated in FIG. 2 is illuminated by use of a parallel wiring system shown in FIG. 3A, or the system shown in a 4A including a dawn to dusk photo sensor. The post lantern low voltage energy conversion device may be illuminated by use of a series wiring system shown in FIG. 3B or the system shown in 4B including a dawn to dusk photo sensor.

It should be clear that the present invention provides a means of converting post lantern natural gas burning lights to low voltage electric power through the post lantern device and wiring system, with the center contact parallel wire lead soldered to a copper ring, which fits into copper groove, into copper sleeve groove, for exclusive use in 12 volt wiring, wired to center contact wires, extending within post lantern pole, extending across residential lawns and then wired to a single 12 volt transformer, or a transformer utilized for several electric devices, which is then plugged into a residential main power source. The post lantern conversion device illuminates bulbs by single contact bayonet bulb placement in inverted copper housing sockets.

It should also be clear that the post lantern low voltage, conversion and wiring device is adaptable to 24 volts dependant upon series wiring, in which center contact parallel wire soldered to copper ring is ignored in wiring process. It then extends through wire pole, across lawns and is wired to a single 24 volt transformer, then plugged into a residential main power source.

It should also be clearly recognized that due to present and projected energy costs, the present invention incorporates a safer, energy efficient, alternative source of energy, which may also be utilized in correlation with dusk to dawn systems. By utilizing single bayonet bulbs, which include incandescent or LED bulbs, coupled with a two bulb device, the invention simulates gas lighting while providing a means of converting post lantern gas luminaries to electric. The invention also allows for conversion of 110 voltage electric to safer, low voltage electric, thereby reducing short circuiting and possible fatalities. The present invention's inverted copper housing bulb sockets, coupled with copper bulb sockets, increase life of the device, prevent internal component corrosion and displacement of the device, thereby completely eliminating device replacement.

What I claim is:

1. A post-lantern low voltage wiring system, illumination, and energy source conversion device comprising:

a bulb housing assembly comprising, an electrically conductive inverted U-shape hollow structural member comprising a left and right electrically conductive bulb socket and an electrically conductive stem sleeve feature descending from the centroid of the inverted U-shape, said inverted U-shape acting as a conductor of heat and electricity between bulb sockets;

a stem having a first end and a second end, the first end attached to the electrically conductive stem sleeve feature of said conductive bulb housing assembly;

first and second center contact wires, one center contact wire routed separately through the right side bulb socket and the other center contact wire routed separately through the left side bulb socket, first and second center contact wires further routed through the stem sleeve feature and further routed through said stem;

at least one bulb socket coil spring disposed coaxially in one of said bulb sockets and contacting an insulative center contact spacer when a lighting bulb is installed in said bulb socket, said insulative center contact spacer having a center mounted electrically conductive nib, said center mounted nib electrically connected to a bulb socket end of one of said first and second center contact wires; and said coil spring urging said center mounted electrically conductive nib of said insulative center contact spacer into electrical contact with a center nib of said lighting bulb.

2. The post-lantern low voltage wiring system, illumination, and energy source conversion device according to claim 1 wherein the second end of the stem is attached to a mounting assembly comprising a threaded nipple, at least one fender washer, and at least one flat nut.

3. The post-lantern low voltage wiring system, illumination, and energy source conversion device according to claim 1 further comprising:

a 24-volt transformer.

4. The post-lantern low voltage wiring system, illumination, and energy source conversion device according to claim 3 further comprising:

a dusk to dawn photo sensor switch.

5. The post-lantern low voltage wiring system, illumination, and energy source conversion device according to claim 1 wherein the lighting bulb is an incandescent type bulb.

6. The post-lantern low voltage wiring system, illumination, and energy source conversion device according to claim 1 wherein the lighting bulb is an LED type bulb.

7. The post-lantern low voltage wiring system, illumination, and energy source conversion device according to claim 1 further comprising:

a 12-volt transformer.

8. The post-lantern low voltage wiring system, illumination, and energy source conversion device according to claim 7 further comprising:

a dusk to dawn photo sensor switch.

9. The post-lantern low voltage wiring system, illumination, and energy source conversion device according to claim 7 further comprising:

A ground wire electrically connected to said conductive bulb housing assembly.

* * * * *